US006843678B2

(12) United States Patent
DeWitt et al.

(10) Patent No.: US 6,843,678 B2
(45) Date of Patent: Jan. 18, 2005

(54) PRESS FIT ELECTRICAL CONNECTOR ASSEMBLY

(75) Inventors: Donald E. DeWitt, Syracuse, IN (US); Scott A. Garver, Fort Wayne, IN (US)

(73) Assignee: Dekko Technologies, Inc., North Webster, IN (US)

( * ) Notice: Subject to any disclaimer, the term of this patent is extended or adjusted under 35 U.S.C. 154(b) by 0 days.

(21) Appl. No.: 10/127,783

(22) Filed: Apr. 22, 2002

(65) Prior Publication Data

US 2003/0199196 A1 Oct. 23, 2003

(51) Int. Cl.[7] ..... H01R 13/56
(52) U.S. Cl. ..... 439/445; 439/447
(58) Field of Search ..... 439/587, 271, 439/351–358, 445–447, 610, 654, 686; 174/102 D

(56) References Cited

U.S. PATENT DOCUMENTS 2,283,117 A * 5/1942 Arutunoff ..... 417/410.1
2,759,765 A * 8/1956 Pawley ..... 239/588
3,819,849 A * 6/1974 Baker ..... 174/86
3,997,230 A * 12/1976 Secretan ..... 439/289
4,245,874 A * 1/1981 Bishop ..... 439/94
4,454,377 A * 6/1984 Neuroth ..... 174/103
5,135,189 A * 8/1992 Ghazizadeh ..... 248/104
5,189,719 A * 2/1993 Coleman et al. ..... 385/101
5,261,706 A * 11/1993 Bartholomew ..... 285/242
5,318,459 A * 6/1994 Shields ..... 439/527
5,727,963 A * 3/1998 LeMaster ..... 439/358
5,876,069 A * 3/1999 Kobayashi ..... 285/24
5,937,537 A * 8/1999 Miller ..... 34/97
6,083,053 A * 7/2000 Anderson et al. ..... 439/687
6,126,477 A * 10/2000 Smith et al. ..... 439/447
6,422,884 B1 * 7/2002 Babasick et al. ..... 439/222
6,464,531 B2 * 10/2002 Eckert et al. ..... 439/465
6,464,543 B2 * 10/2002 Suzuki ..... 439/736
6,595,473 B2 * 7/2003 Aoki et al. ..... 248/74.4

* cited by examiner

*Primary Examiner*—Tho D. Ta
*Assistant Examiner*—Larisa Tsukerman
(74) *Attorney, Agent, or Firm*—Taylor & Aust, P.C.

(57) ABSTRACT

An electrical assembly including at least one electrical conductor, a flexible tubing, a pass-through connector and an electrical component. The flexible tubing with a flexible nature has an end, an inner surface and an outer surface, the flexible tubing loosely carrying the at least one electrical conductor therein. The pass-through connector is disposed on the end of the flexible tubing, the pass-through connector having a generally oval-shaped inner surface coacting with the flexible nature to connect the pass-through connector and the flexible tubing. The electrical component is connected to the pass-through connector, the electrical component electrically connected with the at least one electrical conductor.

24 Claims, 3 Drawing Sheets

PRESS FIT ELECTRICAL CONNECTOR ASSEMBLY

BACKGROUND OF THE INVENTION

1. Field of the Invention

The present invention relates to electrical assemblies, and, more particularly, to press fit connector assemblies.

2. Description of the Related Art

An electrical tubing assembly is used to carry electrical conductors from one location to another and protect the electrical conductors from damage caused by mechanical contact such as may occur during impact or vibration. It is known to provide electrical convoluted tubing to carry electrical conductors from one location to another. Electrical convoluted tubing typically includes a plurality of generally parallel, annular convolutions, which allow the tubing to be flexed as it extends from one location to another. The tubing may include a longitudinal split along one side thereof allowing the electrical conductors to be inserted or removed therefrom.

To prevent the convoluted tubing from being physically damaged and thereby possibly damaging the electrical conductors therein, it is also known to carry the convoluted tubing within a rubber grommet positioned within a cut-out in a mounting bracket. For example, electric motors, engines, household appliances, etc. may include mounting brackets for carrying rubber grommets. The grommet is a separate piece, which is first inserted into a cut-out in the mounting bracket. Thereafter, it is necessary to affix the convoluted tubing to the grommet. A problem with this type of assembly is that often times the tubing may be of considerable length to extend between the desired termination locations. It is difficult to handle the tubing when affixing it to the grommet, which results in considerable time being expended to run the electrical conductors from one location to another. Moreover, it is not uncommon to damage the convoluted tubing as a result of the axial force applied thereto trying to attach the tubing to the grommet. Because of these difficulties, it is fairly common to first run the electrical conductors through the various grommets and then merely cut the convoluted tubing to extend between the grommets without going through the grommet. Electrical conductors may therefore be exposed at locations adjacent to the grommets, allowing the conductors to be physically damaged and possibly causing an electrical shorting condition. Long electrical conductors are also frequently damaged through handling around metal enclosures with this assembly method.

Another problem with a tubing assembly, as described above, is that the one or more electrical conductors typically exit the open ends of the tubing, near a location where the corresponding electrical component, to which the electrical conductors are attached, is positioned. It is thus possible for water, dirt or other foreign matter to enter the tubing at the ends thereof. The tubing thus does not form an integral assembly with the electrical conductors carried thereby, but rather merely functions to protect the electrical conductors from physical damage as the conductors extend from one termination location to another.

Electrical tubing may be hermetically sealed on each end to prevent dirt and moisture from invading the tubing. However, hermetically sealing of electrical tubing makes it impossible or at least difficult to reseal the tubing after electrical conductors are modified or replaced.

What is needed in the art is a tubing assembly, which may be sold as a pre-assembled unit or as components, which may be easily configured, thereby reducing assembly costs and inhibiting physical damage to electrical connectors.

SUMMARY OF THE INVENTION

The present invention provides an electrical tubing assembly with an electrical component such as an electrical connector, plug, etc. at either end thereof, which is associated with electrical conductors passing through the tubing and a press fit pass-through connector.

The invention comprises, in one form thereof, an electrical assembly including at least one electrical conductor, a flexible tubing, a pass-through connector and an electrical component. The flexible tubing with a flexible nature has an end, an inner surface and an outer surface, the flexible tubing loosely carrying the at least one electrical conductor therein. The pass-through connector is disposed on the end of the flexible tubing, the pass-through connector having a generally oval-shaped inner surface coacting with the flexible nature to connect the pass-through connector and the flexible tubing. The electrical component is connected to the pass-through connector, the electrical component electrically connected with the at least one electrical conductor.

An advantage of the present invention is that conventional tubing, such as a convoluted or spiraled tubing is easily and inexpensively transformed into a wiring assembly for conveying electrical power and/or signals from one point to another.

Another advantage is that the electrical assembly can be easily configured.

A further advantage is that electrical components on the ends of the tubing may be replaced without compromising the integrity of the convoluted tubing.

BRIEF DESCRIPTION OF THE DRAWINGS

The above-mentioned and other features and advantages of this invention, and the manner of attaining them, will become more apparent and the invention will be better understood by reference to the following description of the embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
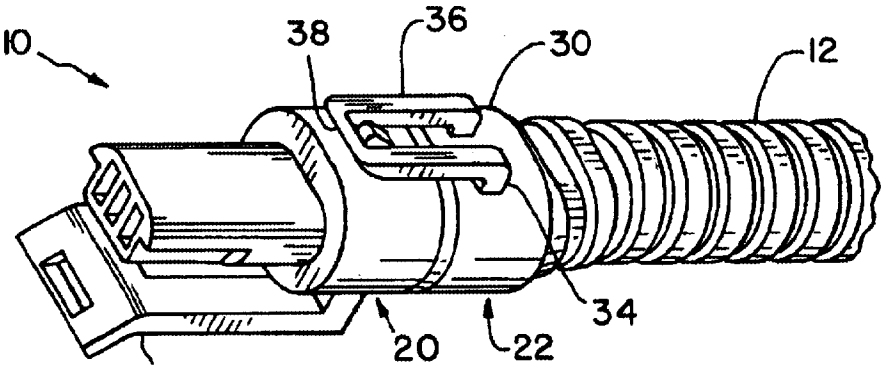
FIG. 1 is a perspective view of an embodiment of an electrical assembly of the present invention.
Figure 2:
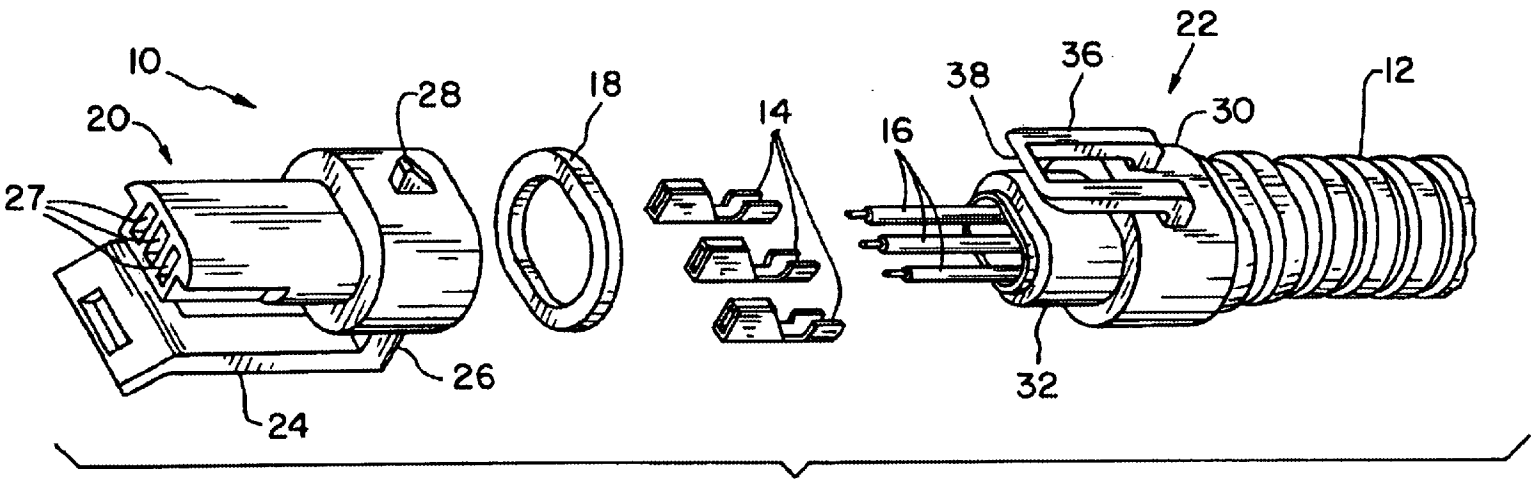
FIG. 2 is an exploded view of the electrical assembly shown in FIG. 1.

Referring now to the drawings, and more particularly to FIGS. 1 and 2, there is shown an embodiment of a press fit connector assembly 10 of the present invention, which generally includes convoluted tubing 12, terminals 14, conductors 16, sealing ring 18, electrical component 20 and press fit pass-through connector 22.

Convoluted tubing 12 loosely carry conductors 16 therein. Convoluted tubing 12 is in the form of tubing having a non-smooth outer surface and a non-smooth inner surface. More particularly, convoluted tubing 12 has a plurality of generally parallel, annular convolutions around the outer surface thereof. The convolutions thus define a plurality of longitudinally adjacent lands and valleys alternately positioned adjacent to each other along the length of convoluted tubing 12. Convoluted tubing 12 is formed from a flexible material such as plastic with convolutions formed therein. Convoluted tubing 12 is formed as a non-helical convolution as illustrated in the figures. The flexible material and convolutions allow convoluted tubing 12 to be positioned or routed along any desired surface so that conductors 16 will likewise be routed from one location to another. For example, convoluted tubing 12 may be used to protectively carry electrical conductors 16 from a junction box to electrical connections associated with an electric motor, generator or engine. Terminals 14, as illustrated in FIG. 2, are of a conventional form having either crimp or soldered connections, which connect with conductors 16. Terminals 14 are shaped to interact with electrical component 20, thereby providing electrical interconnections to and through electrical component 20. Terminals 14 are hermetically interconnected with electrical component 20.

Conductors 16 are insulated conductors, which are routed through convoluted tubing 12, pass-through connector 22 and are connected to terminals 14. Conductors 16 provide for the electrical conveyance of power or signals therethrough. While conductors 16 and terminals 14 are illustrated and discussed herein as electrical conductors and terminals, as an alternative, fiber optic conductors and optic terminations thereof can also be utilized in the tubing systems disclosed herein.

Sealing ring 18 is positioned between electrical component 20 and pass-through connector 22. Sealing ring 18 is made from a compressible material such as rubber or an elastomeric polymer. Alternatively, sealing ring 18 may be an O-ring positioned in a groove on inner surface 25 of electrical component 20, which interfaces with interconnection surface 32 of pass-through connector 22.

Figure 3:
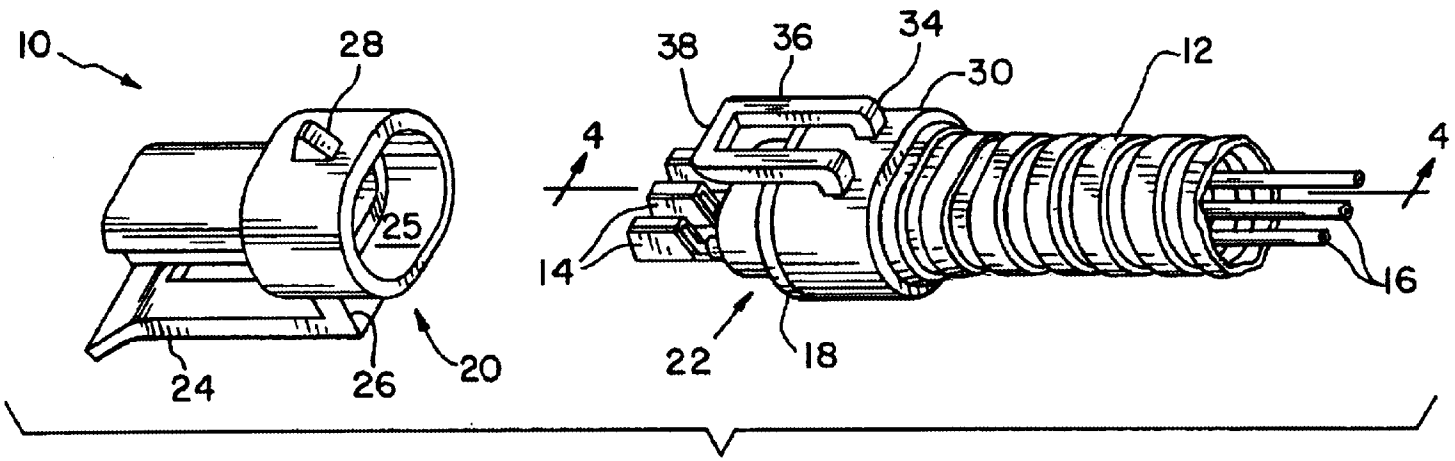
FIG. 3 is another exploded perspective view of the electrical assembly shown in FIGS. 1 and 2.

Electrical component 20 as illustrated in FIGS. 1, 2 and 3 is in the form of an electrical connector 20, which includes a locking mechanism 24, a shoulder 26 and terminal openings 27. Electrical connector 20 is configured to co-act with sealing ring 18 and pass-through connector 22 to provide a hermetic seal when assembled. Electrical connector 20 receives at least one terminal 14 and provides a hermetic seal between terminal 14 and electrical connector 20. Terminal openings 27 provide for electrical interconnection with an external plug or jack of another assembly or electrical component, not illustrated. Alternatively, electrical connector 20 can be an integral part of another assembly.

Locking mechanism 24 is connected to shoulder 26 and extends from electrical connector 20 in the form of two arms with a bridge across the end, having a slot between the two arms. Locking mechanism 24 interacts with another connector assembly, not shown, which is configured to mate with electrical connector 20.

Figure 4:
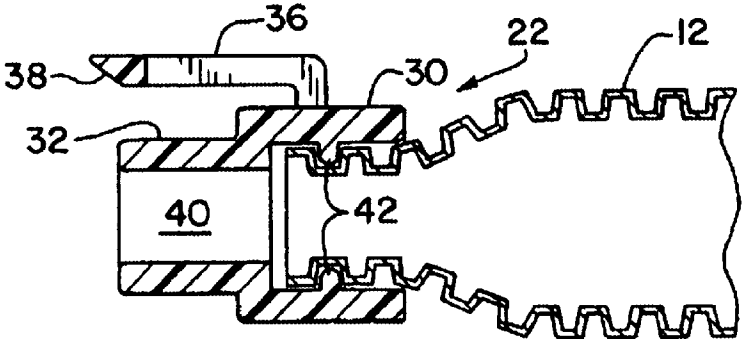
FIG. 4 is a cross-sectional view taken along line 4—4 of the electrical assembly shown in FIG. 3.

Now, additionally referring to FIGS. 3 and 4, there is shown pass-through connector 22 including tubing retaining portion 30, interconnection surface 32, shoulder 34, locking mechanism 36, bridge 38, pass through area 40 and retaining protrusion 42. Tubing retaining portion 30 has a generally oval shape with an inner perimeter length, which approximates the outer diameter circumference of convoluted tubing 12. The shape of tubing retaining portion 30 is selected to take advantage of the flexibility of convoluted tubing 12 to retain convoluted tubing 12 in pass-through connector 22. When convoluted tubing 12 is inserted into tubing retaining portion 30, convoluted tubing 12 is placed into compression in tubing retaining portion 30.

Interconnection surface 32 is shaped and sized to interact with electrical connector 20. Interconnection surface 32 is inserted into electrical connector 20 and may provide a sealing surface for an O-ring inserted into electrical connector 20.

Locking mechanism 36 is attached by way of shoulder 34 to an outer surface of tubing retaining portion 30. Locking mechanism 36 extends outwardly from pass-through connector 22 to interact with electrical connector 20, so as to, physically engage and hold in place, electrical connector 20. At one end of locking mechanism 36 is bridge 38, which interacts with ramped protrusion 28 of electrical connector 20 to ensure positioning and locking engagement thereof.

Pass through area 40, as depicted in FIG. 4, allows conductors 16 to pass-through connector 22 into convoluted tubing 12. Conductors 16 extend to another end of convoluted tubing 12, having a similar pass-through connector 22 thereon.

Retaining protrusion 42 is located on an inner surface of tubing retaining portion 30. Retaining protrusion 42 is arranged to co-act with the flexible nature of convoluted tubing 12 and the valleys of convoluted tubing 12 to retain convoluted tubing 12 in pass-through connector 22. Alternatively, convoluted tubing 12 may be secured, within pass-through connector 22, by an adhesive or a thermal melting process.

Alternatively, press fit connector assembly 10 may omit both a sealing ring 18 and locking mechanism 36 on pass-through connector 22. Sealing between pass-through connector 22 and electrical conductor connector 20 may be accomplished with an adhesive, a sealant or a thermal melting process.

Press fit connector assembly 10 can be supplied as separate components for customization or as a complete assembly. Conductors 16, within electrical press fit connector assembly 10, may be readily modified or repaired by disengaging locking mechanism 36 from ramped protrusion 28, changing a conductor within press fit connector assembly 10 and reassembling press fit connector assembly 10.

Press fit connector assembly 10 is assembled by first compressing one end of convoluted tubing 12 and pushing it into tubing retaining portion 30 so that a land and a valley of convoluted tubing 12 co-acts with retaining protrusion 42, thereby retaining convoluted tubing 12 inside of pass-through connector 22. Assuming that a pass-through connector 22 has been press fit on each end of convoluted tubing 12, conductors 16 are routed through pass-through connector 22, convoluted tubing 12 and another pass-through connector 22. The ends of conductors 16 are electrically connected to terminals 14, either prior to, or after, being routed through tubing 12. Terminals 14 are then inserted through sealing ring 18 and into terminal openings 27 by way of the back portion of electrical connector 20. Any extra length of conductor 16 is pushed back into pass-through connector 22 and into convoluted tubing 12. Electrical connector 20 is oriented as shown in FIGS. 2 and 3 and is lockingly engaged, by way of locking mechanism 36, with pass-through connector 22, thereby compressing sealing ring 18 and sealing the assembly.

Retaining protrusion 42, although depicted as a protruding ring about an inner surface of tubing retaining portion 30, may consist of multiple protrusions located at various points around the inner surface of tubing retaining portion 30. Alternatively, retaining protrusion 42 may be omitted and convoluted tubing 12 attached to tubing retaining portion 30 by way of an adhesive sealant or a heating process.

Figure 5:
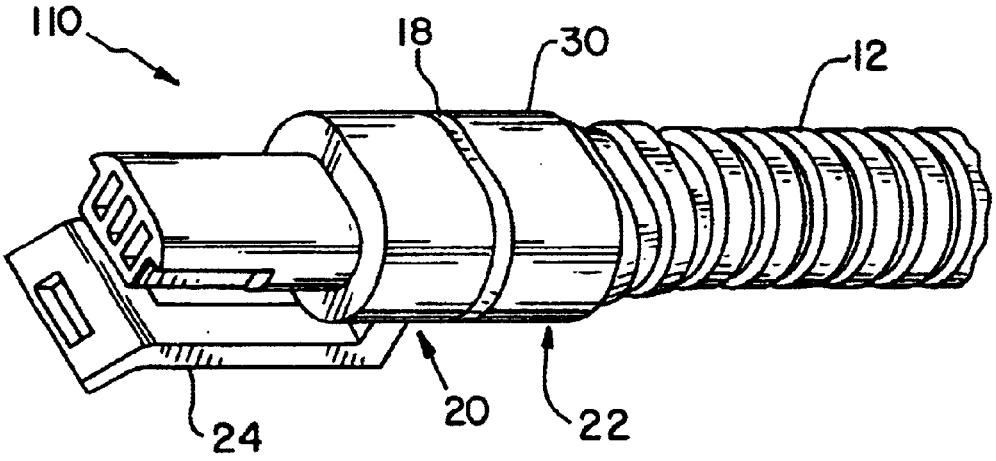
FIG. 5 is a perspective view of another embodiment of an electrical assembly of the present invention.

Now, referring additionally to FIG. 5, there is shown another embodiment of a press fit connector assembly 110 of the present invention, which generally includes convoluted tubing 12, sealing ring 18, electrical component 20 and press fit pass-through connector 22. This embodiment is substantially similar to the previous embodiment except that pass-through connector 22 does not have locking mechanism 36, nor does electrical connector 20 have ramped protrusion 28. Convoluted tubing 12 is secured within pass-through connector 22, e.g., by retaining protrusion 42, an adhesive and/or a thermal melting process.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical assembly, comprising:

at least one electrical conductor;

a flexible tubing having an end, an inner surface and an outer surface, said flexible tubing loosely carrying said at least one electrical conductor therein, said flexible tubing being compressible, said flexible tubing being non-helically convoluted;

a pass-through connector disposed on said end, said pass-through connector having a an oval-shaped inner surface coacting with said flexible tubing to compressively connect said flexible tubing to said pass-through connector, said pass-through connector loosely carrying said at least one electrical conductor; and an electrical component connected to said pass-through connector, said electrical component electrically connected with said at least one electrical conductor.

2. The assembly of claim 1, further comprising a sealing ring disposed between a surface of said pass-through connector and a surface of said electrical component, thereby providing a hermetical seal between said pass-through connector and said electrical component.

3. The assembly of claim 1, further comprising a plurality of terminals, each of said plurality of terminals connected to an end of a corresponding one of said at least one electrical conductor, at least one of said plurality of terminals insertable into said electrical component.

4. The assembly of claim 1, wherein said pass-through connector includes a locking mechanism for detachably locking said electrical component thereto.

5. The assembly of claim 1, wherein said electrical component has a surface with a locking mechanism located thereon.

6. The assembly of claim 1, further comprising an other pass-through connector and an other electrical component, said other pass-through connector disposed on an other end of said flexible tubing, said other electrical component connected to said at least one electrical conductor, said other electrical component in hermetically sealing contact with said other pass-through connector.

7. The assembly of claim 1, wherein said electrical component is in hermetically sealing contact with said pass-through connector.

8. The assembly of claim 1, wherein said generally oval-shaped inner surface is at least partially in physical contact with said outer surface of said flexible tubing being connected by way of at least one of an adhesive, a thermal process and compression.

9. The assembly of claim 1, wherein said generally oval-shaped inner surface of said pass-through connector includes at least one protrusion.

10. The assembly of claim 9, wherein said flexible tubing includes lands and valleys, at least one said land and valley co-acting with at least one of said at least one protrusions thereby connecting said flexible tubing to said pass-through connector.

11. A tubing system for carrying at least one electrical conductor therein, comprising:

a flexible tubing having an end and an outer surface, said flexible tubing being compressible, said flexible tubing being non-helically convoluted; and a pass-through connector having an oval-shaped inner surface with at least a portion of said end disposed therein, said flexible tubing being at least partially compressively disposed within said pass-through connector.

12. The system of claim 11, further comprising an electrical component in hermetically sealing contact with said pass-through connector.

13. The system of claim 12, further comprising a plurality of terminals, each of said plurality of terminals connected to an end of one of said at least one electrical conductor, said terminals insertable into said electrical component.

14. The system of claim 12, further comprising a sealing ring disposed between a surface of said pass-through connector and a surface of said electrical component.

15. The system of claim 12, wherein said pass-through connector includes a locking mechanism for detachably locking said electrical component thereto.

16. The system of claim 12, wherein said electrical component has a surface with a locking mechanism thereon.

17. The system of claim 11, further comprising an other pass-through connector disposed on an other end of said flexible tubing.

18. The system of claim 17, further comprising at least one electrical component connected to at least one of said pass-through connectors and said other pass-through connector in hermetically sealing contact.

19. The system of claim 11, wherein said generally oval-shaped inner surface is at least partially in physical contact with said outer surface of said flexible tubing being connected by way of at least one of an adhesive, a thermal process and compression.

20. The system of claim 11, wherein said generally oval-shaped inner surface includes at least one protrusion.

21. The system of claim 20, wherein said flexible tubing includes lands and valleys, at least one said land and valley coacting with at least one of said at least one protrusions thereby connecting said flexible tubing to said pass-through connector.

22. A method of assembling a tubing system, comprising the steps of:

pressing a flexible tubing into an oval shaped inner surface of a pass-through connector; and passing at least one electrical conductor through said pass through connector and through said flexible tubing.

23. The method of claim 22, further comprising the step of connecting an electrical component to said pass-through connector, said electrical component electrically connected with said at least one electrical conductor, said flexible tubing being convoluted.

24. The method of claim 23, further comprising the step of retaining said flexible tubing in said pass-through connector by way of an interaction between lands and valleys of said flexible tubing and retaining protrusions of said pass-through connector.

* * * * *

UNITED STATES PATENT AND TRADEMARK OFFICE

CERTIFICATE OF CORRECTION

PATENT NO. : 6,843,678 B2
DATED : January 18, 2005
INVENTOR(S) : DeWitt et al.

It is certified that error appears in the above-identified patent and that said Letters Patent is hereby corrected as shown below:

Column 4,
Line 20, between "to" and "pass-through", insert -- pass through --.

Signed and Sealed this

Fourteenth Day of June, 2005

JON W. DUDAS
*Director of the United States Patent and Trademark Office*